United States Patent [19]

Ogita et al.

[11] 4,278,980

[45] Jul. 14, 1981

[54] ANTENNA INPUT CIRCUIT FOR RADIO RECEIVER

[75] Inventors: Minoru Ogita; Masahiro Takeyama, both of Hamamatsu, Japan

[73] Assignee: Nippon Gakki Seizo Kabushiki Kaisha, Hamamatsu, Japan

[21] Appl. No.: 24,854

[22] Filed: Mar. 28, 1979

[30] Foreign Application Priority Data

Mar. 30, 1978 [JP] Japan ..... 53-37164

[51] Int. Cl.[3] ..... H01Q 7/00

[52] U.S. Cl. ..... 343/748; 343/867; 455/274

[58] Field of Search ..... 343/702, 744, 867, 748; 455/270, 273, 274

[56] References Cited

U.S. PATENT DOCUMENTS

| | | | |
|---|---|---|---|
| 2,237,260 | 4/1941 | McDonald | 343/867 |
| 2,292,163 | 8/1942 | Shea | 343/867 |
| 2,315,315 | 3/1943 | Cairnes | 343/702 |
| 2,318,516 | 5/1943 | Newbold | 343/702 |
| 2,322,126 | 6/1943 | Grimditch | 343/702 |
| 2,339,619 | 1/1944 | Craig | 343/702 |
| 2,388,567 | 11/1945 | Patterson | 343/702 |
| 2,401,472 | 6/1946 | Franklin | 343/873 |
| 2,535,053 | 12/1950 | Ercolino | 343/867 |
| 3,122,747 | 2/1964 | Heisrath | 343/866 |
| 3,530,473 | 9/1970 | Ives | 343/702 |
| 3,560,983 | 2/1971 | Willie et al. | 343/744 |
| 3,918,062 | 11/1975 | Haruki et al. | 343/702 |

FOREIGN PATENT DOCUMENTS

| | | |
|---|---|---|
| 711548 | 10/1941 | Fed. Rep. of Germany . |
| 1182315 | 7/1962 | Fed. Rep. of Germany . |
| 1282744 | 7/1966 | Fed. Rep. of Germany . |
| 36407 | 4/1965 | German Democratic Rep. . |

OTHER PUBLICATIONS

Grundig et al., German Published Application, 21a[4], 47.G3404, 6-7-51.

Telefunken, German Published Application, 21a[4], 47.T4354, 7-3-52.

*Primary Examiner*—Eli Lieberman

*Attorney, Agent, or Firm*—Cushman, Darby & Cushman

[57] ABSTRACT

A low-impedance loop antenna for receiving medium-frequency-band radio waves has an inductance of 1 microhenry up to 100 microhenries and an effective loop area larger than 20 cm$^2$, whereby it is capable of receiving radio waves with a markedly improved rejection of undersirable radiations in the form of electric field from external noise sources. Such low-impendance loop antenna is coupled to a radio receiver via an input transformer whereat the impedance of this antenna is stepped up for the purpose of impedance matching. The input transformer has a primary winding provided with a tap adapted to be connected to the antenna and whose ends are connected to a variable capacitor constituting a tuning circuit jointly with the input transformer.

13 Claims, 13 Drawing Figures

ANTENNA INPUT CIRCUIT FOR RADIO RECEIVER

BACKGROUND OF THE INVENTION (a) Field of the Invention

The present invention is related to an antenna for the reception of MF (Medium Frequency)-band radio waves, and an input circuit for such antenna suitable for a radio receiver.

(b) Description of the Prior Art

In the MF-band, radio broadcasting is conducted usually on an AM (amplitude-modulation) system, and thus radio broadcasting tends to be more susceptible to interference by noise radiations from various external noise sources than is FM (Frequency-Modulation) broadcasting in the VHF (Very-High-Frequency)-band.

In the MF-band, generally, the interfering noise radiations may be considered to have three kinds of forms including electromagnetic wave, magnetic field and electric field. In a usual condition to use a radio receiver, the noise radiation in the form of electromagnetic wave applied to the receiver is at a sufficiently low level of magnitude as compared with the radiations in the other two kinds of forms. Radiations in the form of magnetic field and electric field, on the other hand, are at a relatively high level of magnitude as, for example, in MF-band. However, radiation in the form of magnetic field rapidly attenuates during propagation in proportion to the third-power of the propagation distance, so that such radiation usually would not cause a serious problem for a receiver installed at a site relatively remote from the noise source. Therefore, it is the radiation in the form of electric field that is most problematical and requires solution in, for example, MF-band radio reception, since the level of magnitude of this radiation will decrease only in proportion to the second-power of the propagation distance from the noise source.

For the reasons stated above, magnetic-field-sensitive type antenna are advantageously used for the reception of MF-band radio ways. In fact, it has been the common practice that MF-band radio receivers employ a ferrite-bar antenna which has been considered to be sensitive, in principle, to magnetic fields only. Nevertheless, such radio receivers are more or less interfered by noise radiations of electric field for the reasons as will be described below.

A known typical ferrite-bar antenna and its connection to a radio receiver are schematically depicted in FIG. 1, in which the antenna, generally indicated at 1, includes a bar or stick member 2 made of a ferrite material, and primary and secondary windings 3 and 4 formed on a bobbin 5 which is slidably or non-slidably mounted on the bar member 2. The primary winding 3 is operative as a tuning coil, and is connected to a variable capacitor, i.e. a tuning capacitor 6, in the receiver to form a tuning circuit. Received and tuned radio signals are delivered from the secondary winding 4 to a front end circuit (not shown) of the receiver. The inductance of the primary winding 3 is usually about 300 microhenries or more, so that the ferrite-bar antenna will naturally entail a high-impedance portion, of which an impedance reaches one or several hundreds of kilo-ohms over MF-band frequencies. Such a high-impedance portion of the antenna including the primary winding 3 and often including a certain length of the antenna leads naturally is required to be installed outside the radio circuitry which is shielded from static electricity. Therefore, such portion of antenna inconveniently tends to catch noise radiations which are in the form of electric field. As such, the conventional ferrite-bar antenna is relatively susceptible, against expectation, to interference by noise radiations of electric field.

It should also be understood that such high-impedance antenna, in turn, will limit the extension of the antenna leads from the antenna and the receiver. If the antenna leads are extended for a substantial distance, the possibility of interference by noise electric-field radiations will increase accordingly, and besides an increased stray capacitance on the antenna leads would impose an adverse effect on the operation of the tuning circuit of the receiver. In the past, therefore, conventional ferrite-bar antenna has to be installed close to the receiver, so that the antenna leads may be minimized of their length.

A popular antenna installation often adopted in AM radio receivers is schematically shown in FIG. 2, in which a ferrite-bar antenna 1 is swingably supported by supporting means 8 on the rear panel of receiver 7, with the antenna leads 9 being drawn into the receiver so as to run a possible shortest distance from the antenna. This arrangement provides the convenience that the direction of the antenna 1 can be adjusted at will for achieving an optimum receiving condition. On the other hand, however, such arrangement requires a relatively large space for allowing the swinging movement of the antenna bar 1 on the rearside of the receiver. Although the necessity for such large space may not cause much inconvenience in the case of portable-type radio receivers, this type of requirement quite often fails to be met in case of console-type radio receivers because they are usually installed close to a room wall, a corner of a room, or by the side of furniture, in such a way that the rear panel of the receiver faces the wall or the furniture. In such console-type radio receiver, it would certainly be convenient if an antenna can be installed at any arbitrary desired location away from the rear panel or the receiver per se. However, such arrangement of location of the antenna would, in most cases, require extended antenna leads or wires for the connection of the antenna to the receiver.

SUMMARY OF THE INVENTION

It is, therefore, an object of the present invention to provide an improved antenna of magnetic-field-sensitive type for the reception of MF-band radio waves, which is much less susceptible to interference by radiations of electric field from external noise sources.

Another object of the present invention is to provide an antenna of the type described above, which allows its installation at a location remote from the radio receiver substantially without the accompaniment of noise problem.

According to the present invention, therefore, a low-impedance loop antenna is provided which has its inductance ranging from 1 microhenry up to 100 microhenries.

Still another object of the present invention is to provide an antenna input circuit for a radio receiver, which is suitable for the connection of a low-impedance loop antenna according to the present invention.

These and other objects, the features as well as the advantages of the present invention will become apparent from the following detailed description of the preferred embodiments when taken in conjunction with the accompanying drawings.

DETAILED DESCRIPTION OF THE PREFERRED EMBODIMENTS

A low-impedance loop antenna according to the present invention is essentially characterized in that it has a low inductance of 1 microhenry up to 100 microhenries, preferably less than 30 microhenries. This low inductance is effective for the loop antenna to ensure the reception of MF-band radio waves with a much higher rejection of noise radiations in the form of electric field from external noise sources, for the following reasons.

Figure 1:
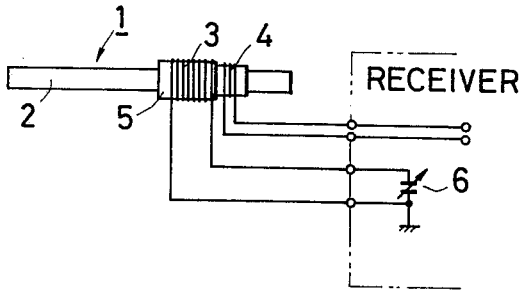
FIG. 1 PRIOR ART
FIG. 1 illustrates a schematic ferrite-bar antenna and its connection to a radio receiver according to the prior art.
Figure 2:
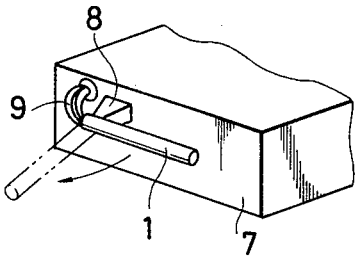
FIG. 2 PRIOR ART
FIG. 2 is an explanatory illustration of a known typical installation arrangement of a ferrite-bar antenna on a radio receiver.
Figure 3:
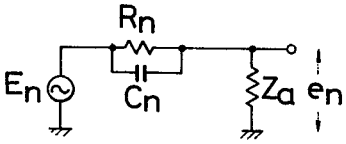
FIG. 3 schematically illustrates the principles of noise rejection in a low-impedance loop antenna according to the present invention.

In FIG. 3 which shows the principles of the antenna according to the present invention, the propagation process of radiation of electric field from an external noise source to an antenna can be illustrated, in which: $Z_a$ represents the impedance of the antenna; $E_n$ represents the equivalent noise electromotive force of the noise source, and $R_n$ and $C_n$ represent the equivalent resistance and capacitance of the propagation path between the noise source and the antenna. The induced voltage $e_n$ across the antenna impedance $Z_a$ is given by:

$$e_n = E_n \cdot \frac{Z_a}{Z_a + Z_c},$$

wherein $Z_c$ is the effective impedance of the two elements $R_n$ and $C_n$ which are in parallel with each other. $Z_c$ is usually greatly larger than $Z_a$, and hence the above equation may be simplified as:

$$e_n = E_n \cdot \frac{Z_a}{Z_c}.$$

For a particular condition of propagation, $Z_c$ attains a certain fixed value independently of the antenna employed. Therefore, $e_n$ is almost proportional only to $Z_a$. Since $Z_a$ is determined mainly by the inductance of the antenna, $e_n$, which is the noise signal induced in the antenna, may be considered as being proportional to the antenna inductance.

As will be apparent from the above-made discussion, the low-impedance loop antenna according to the present invention, which has a lower inductance (from 1 microhenry up to 100 microhenries) than 300 microhenries or more of the conventional ferrite-bar antenna, is much less susceptible to interference by external noise radiations of electric field. For 100 microhenries, for example, the degree of interference will be reduced to below one third of that of a corresponding ferrite-bar antenna having an inductance of 300 microhenries. Namely, the noise rejection factor becomes three times as high as the 300-microhenry ferrite-bar antenna, and this increase in noise rejection should be termed high. Similarly, for 30 microhenries and 10 microhenries, the degree of interference will be reduced to below one tenth and one thirtieth, respectively. The lower limit, one microhenry, of the antenna inductance is specified mainly in view of the allowable minimum loop area required for attaining an allowable minimum degree of radio-wave receiving sensitivity which depends essentially on the loop area. More than 20 $cm^2$ of the effective loop area may be usually needed in known MF-band radio receivers.

Moreover, because of its low inductance or impedance, the low-impedance loop antenna of the invention has another critical advantage that it permits its installation at a location remote from a receiver without being accompanied by any trouble. This advantage will provide a great convenience in antenna installation.

Figure 4:
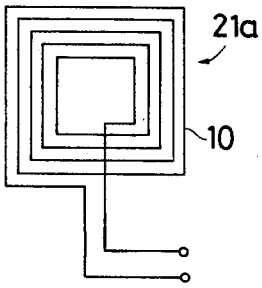
FIGS. 4 to 7 schematically illustrate several embodiments of a low-impedance loop antenna according to the present invention.
Figure 5:
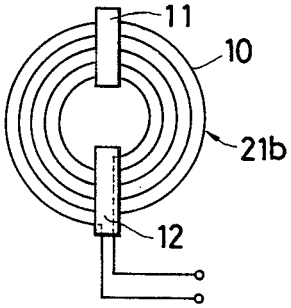
Figure 6:
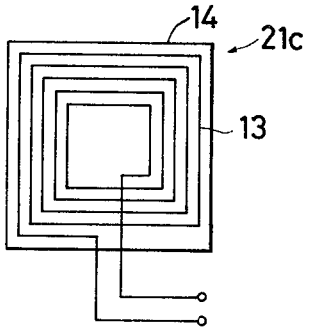

Such low-impedance loop antenna of the present invention may be formed with a conductor wire or layer prepared in the form of substantially a flat coil, several examples of which are schematically illustrated in FIGS. 4 to 6.

The example of low-impedance loop antenna shown in FIG. 4, indicated generally at 21*a*, is comprised of a conductor wire 10 having several turns, e.g. a copper wire which is formed into a flat, square coil.

In FIG. 5, the low-impedance loop antenna, generally indicated at 21*b*, comprises a conductor wire 10 having several turns in a flat, circular coil. This antenna is held in shape by moldings 11 and 12 made with, for instance, a synthetic resin provided at opposite ends of the antenna. The antenna leads are led out through one of these moldings.

It should be noted that the loop antenna as shown in FIGS. 4 and 5 may be formed on a coil form or support made with a non-magnetic material for ensuring the dimensions thereof.

The example of the low-impedance loop antenna shown in FIG. 6, indicated generally at 21*c*, is formed with copper foil or layer 13 having several turns shaped into a square coil, and this foil is printed on a non-magnetic plate member 14 by relying on, for example, the conventional print circuit technique. Needless to say, this example may be entirely covered with a film or a molding of a non-magnetic material.

Figure 7:
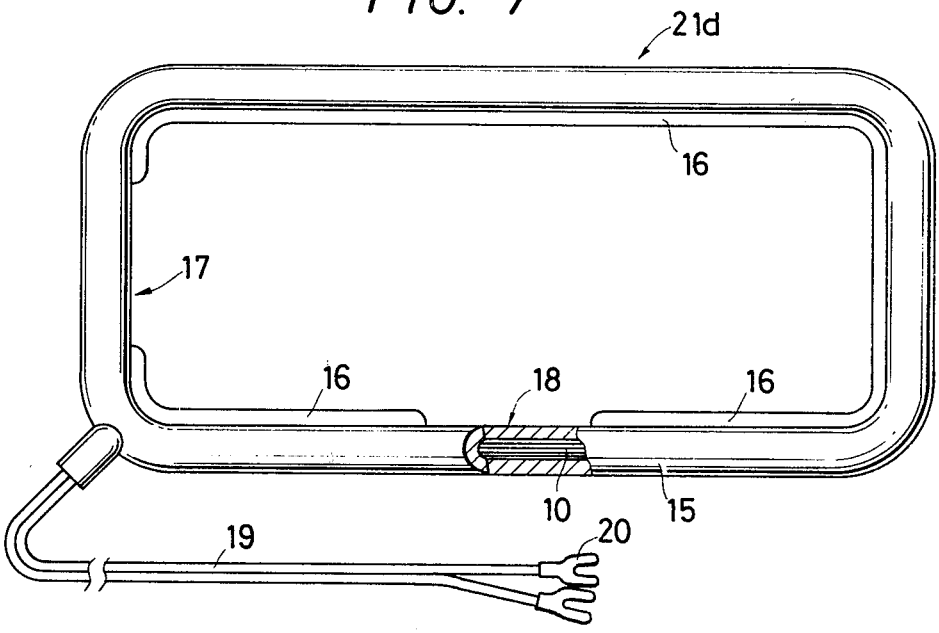

A more practical example of a low-impedance loop antenna 21*d* according to the present invention is shown schematically, partly in section, in FIG. 7, which comprises a rectangular sheath 15 made with a non-magnetic material, e.g. a synthetic resin, in which a conductor wire 10 having several turns formed as a substantially rectangular coil is entirely enclosed. The rigidity of this antenna is strengthened by a longitudinal rib portion 16 formed integrally with the sheath 15 on the inner surface thereof. The rib portion 16 is partly removed to provide supporting portions 17 and 18 which are circular in section, at which portions the antenna may be rotatably gripped by supporting means on a radio receiver. The antenna leads, indicated in the Figure as a twin-wire cable 19 with connection terminals 20 provided at its end is taken out from a corner portion of this sheath 15.

Figure 8:
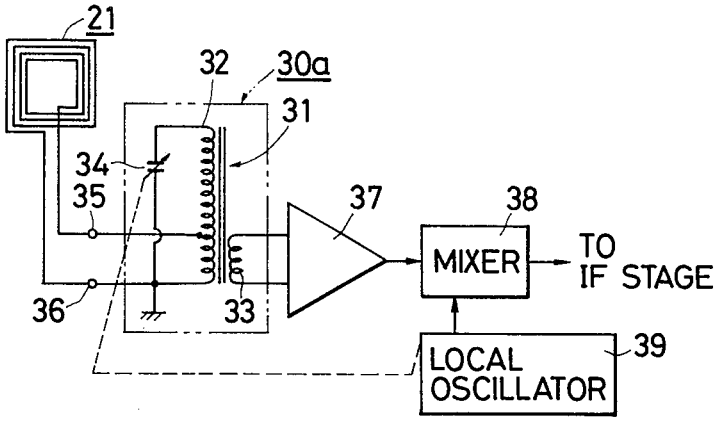
FIG. 8 schematically illustrates an example of antenna input circuit embodying the present invention.

According to the present invention, there is also provided an antenna input circuit for a radio receiver, which is intended for the connection of such low-impedance loop antenna as described and illustrated hereinbefore, and a basic example of which is illustrated schematically in FIG. 8. The antenna input circuit, generally indicated at 30*a*, includes an input transformer 31 with a primary winding 32 and a secondary winding 33. In parallel with these members and across the ends of the primary winding 32 is connected a variable capacitor 34, which serves as a tuning capacitor, to form a tuning circuit. A low-impedance loop antenna of the present invention, generally indicated at 21, is connected via antenna terminals 35 and 36 between a tap lead and a grounded end lead of the primary winding 32.

An MF-band signal (AM-broadcast signal) received and tuned is delivered from the secondary winding 33 to an RF (Radio Frequency)-amplifier 37 of the front end of the receiver. The amplified signal outputted from the RF-amplifier 37 is mixed, in the mixer 38, with a local carrier generated at a local oscillator 39 to be converted to a corresponding intermediate frequency signal which is fed to following stages (not shown) of the receiver.

Usually, the tuning capacitor 34 is ganged to a variable capacitor (not shown) which serves to alter the oscillation frequency of the local oscillator 39. Also, it is the common practice that the primary winding 32 of the input transformer 31 has an inductance around 300 microhenries in view of a practical range of capacitance of the tuning capacitor 34 employed. Thus, the input transformer 31 has a suitable ratio of the number of turns of the primary winding 32 between both end leads to between the tap lead and a grounded end lead, and a suitable ratio of the primary winding 32 to the secondary winding 33 so as to carry out a stepping-up of the low-impedance of the loop antenna 21 to thereby provide an impedance matching with the RF-amplifier 37.

With the above arrangement, the antenna input circuit 30*a* containing the high-impedance tuning circuit easily can be enclosed entirely within electrostatic shielding means (not shown), and on the other hand, only the low-impedance loop antenna 21 and its connection leads are exposed outside the shielding means. Therefore, a higher rejection of noise radiations in the form of electric field can be attained.

Figure 9:
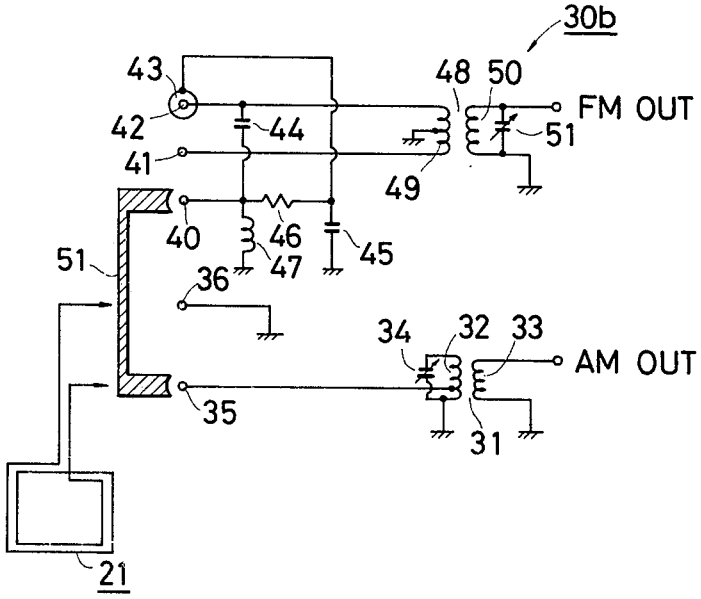
FIG. 9 schematically illustrates another example of antenna input circuit embodying the present invention.

Another example of an antenna input circuit for an AM/FM radio receiver is schematically illustrated in FIG. 9, which example enables the receiver to receive an MF-band AM broadcast by using either a low-impedance loop antenna of the present invention or a VHF-band FM broadcast receiving antenna.

Referring now to FIG. 9, the antenna input circuit, generally indicated at 30*b*, includes antenna terminals 35 and 36 which are adapted to be coupled to a low-impedance loop antenna 21 of the present invention, antenna terminals 40 and 41 connectable to respective leads of a twin-lead type feeder from an FM-receiving antenna (not shown), and antenna terminals 42 and 43 shown in the form of a jack adapted to be coupled to a center wire and to a shielding sheath, respectively, of a coaxial cable extending from an FM-receiving antenna (not shown). The antenna input circuit further comprises an AM-receiving input transformer 31 such as is explained in connection with the example of FIG. 8. The transformer 31 has a primary winding 32 with both end leads arranged in parallel with a tuning variable capacitor 34, and a secondary winding 33 from which a received and tuned AM-broadcast signal is delivered. The antenna terminal 35 is connected to a tap lead of the primary winding 32, and the antenna terminal 36 is grounded.

The antenna input circuit is equipped with another input transformer 48 for FM-broadcast reception, whose primary winding 49 is grounded at its center tap lead and connected to the antenna terminals 41 and 42 at its respective end leads. The secondary winding 50 of the input transformer 48 is provided in parallel with another variable capacitor 51 to form another tuning circuit. The antenna terminal 43 is connected through a capacitor 45 to the ground of the circuitry. This capacitor 45 has such capacitance that it may substantially pass VHF-band signals (FM-broadcast signals) to thereby ground the terminal 43 for VHF-band signals, but that it may offer a sufficiently larger impedance to MF-band signals (AM-broadcast signals) than the inductance of an inductor 47 which is substantially the same as that of the low-impedance loop antenna 21. The antenna terminals 40 and 42 are mutually connected through a capacitor 44 which has such a capacitance as will substantially prevent the passage of MF-band signals but will allow VHF-band signals to pass therethrough. The antenna terminal 40 is connected also to the ground through the inductor 47, and further to the antenna terminal 43 via a resistor 46.

The antenna input circuit further includes a conductor member 51 serving as short-circuiting means between the antenna terminals 35 and 40, and this conductor member is detachably attached across these two terminals.

When a reception of AM-broadcast is intended by connecting the low-impedance loop antenna of the present invention to the antenna terminals 35 and 36, the conductor member 51 is removed from the antenna terminals 35 and/or 40. Received AM-broadcast signals at the loop antenna are fed via terminals 35 and 36 to the input transformer 31, wherein one signal is tuned.

Alternatively, when reception of AM-broadcasts is intended without the connection of the low-impedance loop antenna 21 but only with an FM-receiving antenna, the conductor member 51 is attached for short-circuiting between the antenna terminals 35 and 40.

In this latter case, if a twin-lead type feeder from an FM-receiving antenna is connected to the antenna terminals 40 and 41, one wire of the feeder connected to the antenna terminal 40 is effective to serve as a sort of long-wire antenna by which AM-broadcast signals are captured. Such received AM-broadcast signals at MF-band frequencies cannot be fed to the FM-receiving input transformer 48 because of high impedance of the capacitor 44, but can be fed via the conductor member 51 to the AM-receiving input transformer 31. It will be seen easily that, because of the provision of the inductor 47, the tap lead of the primary winding 32 of the input transformer 31 which serves as a tuning coil is always shunted by substantially the same impedance, and thus that the tracking characteristic of the tuning circuit remains substantially unchanged independently of whether or not the low-impedance loop antenna 21 is connected for the reception of AM-broadcasts. Needless to say, FM-broadcast signals received by the connection of the FM-receiving antenna are transmitted to the primary winding 49 of the FM-receiving input transformer 48. If, on the other hand, a coaxial cable from an FM-receiving antenna is connected to the antenna terminals 42 and 43, the outer shielding sheath of the cable will serve as an AM-receiving antenna, but in such case it is substantially grounded for VHF-band FM-broadcast signals by the capacitor 45. Thus, AM-broadcast signals received on the shield sheath are fed only to the AM-receiving input transformer 31 via the resistor 46 and the conductor member 51, while the received FM-broadcast signals are applied across one of the end leads and the center tap lead of the primary winding 49 of the FM-receiving input transformer 48.

As has been discussed, a low-impedance loop antenna of the present invention allows the use of a relatively lengthy wire for the connection of the antenna to a receiver, so that the loop antenna can be installed in a variety of manners as required.

Figure 10:
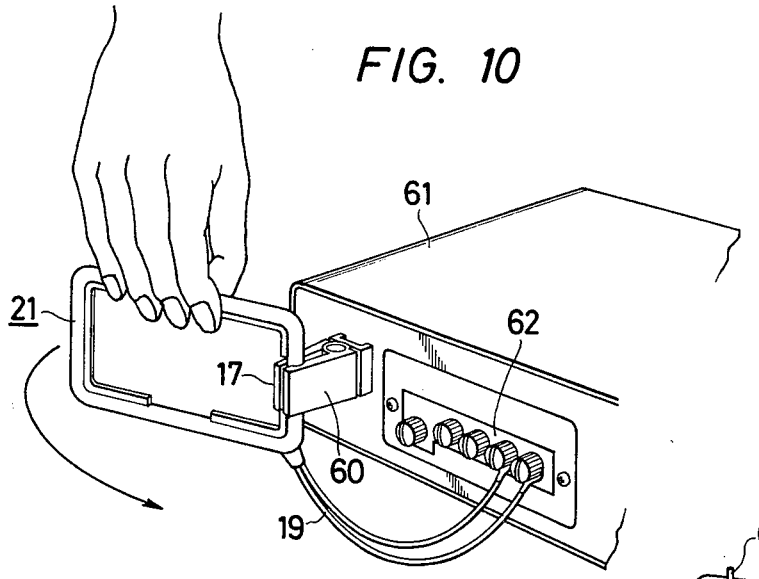
FIGS. 10 and 11 are explanatory illustrations of different ways of installation of a low-impedance loop antenna according to the invention.

FIG. 10 schematically illustrates an example of installation of a low-impedance loop antenna, in which such low-impedance loop antenna 21 as explained in connection with FIG. 7 is swingably supported by supporting means 60 on the rear panel of a radio receiver 61. The supporting means 60 includes a pair of gripping portions having cylindrical receiving surfaces in which the supporting portion 17 of circular section of the loop antenna 21 is rotatably gripped for horizontal swinging movement of the antenna. Since AM-broadcast waves are usually vertically-polarized waves, the loop antenna 21, which is of the magnetic-field-sensitive type, is supported vertically. The connection wires 19 extending from the loop antenna are led to antenna terminals on a terminal board 62, which terminals being connected to an input circuit as shown previously in FIGS. 8 and 9.

Figure 11:
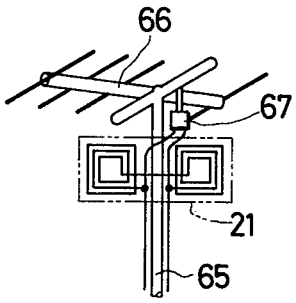

Another example of installation of a low-impedance loop antenna is schematically illustrated in FIG. 11, in which a low-impedance loop antenna 21 hangs itself on a hook 63 attached onto a room wall 64. The connection wires 19 extending from a radio receiver 61 extend to the receiver via a relatively long distance.

Figure 12:
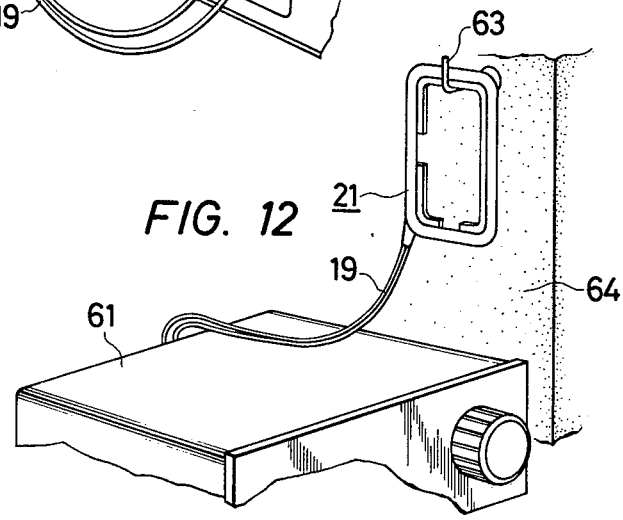
FIG. 12 schematically illustrates another way of installation of a low-impedance loop antenna according to the invention.

FIG. 12 illustrates a further example of antenna installation, in which a low-impedance loop antenna 21 formed in two leaves of coil is installed on a pole 65 on top of which an FM-receiving antenna 66 is supported. The FM-receiving antenna 66 is connected via an impedance-matching transformer 67 and a capacitor 68 (see FIG. 13) to a coaxial transmission cable 69 (see FIG. 13) to which the output leads of the loop antenna 21 are connected.

Figure 13:
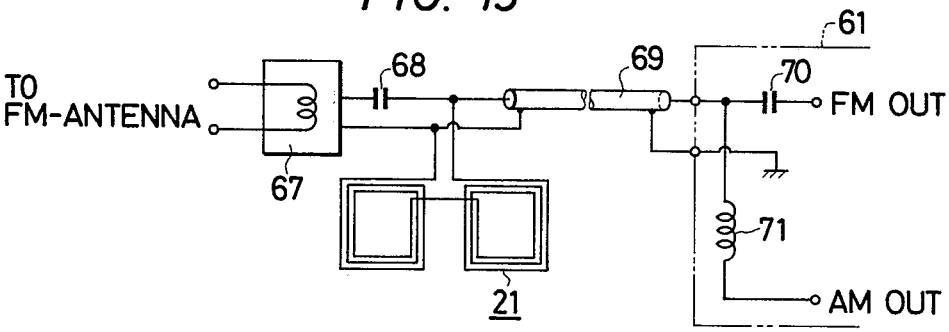
FIG. 13 schematically illustrates an example of connection of such low-impedance loop antenna as that installed in the way shown in FIG. 12.

Such FM-receiving antenna 66 and AM-receiving loop antenna 21 may be connected to a radio receiver 61 in a manner as shown in FIG. 13. In the Figure, the output end of a shielding sheath of the coaxial cable 69 is grounded in the radio receiver 61, and the output end of the center wire is connected to antenna input circuit for FM- and AM-broadcast reception via a capacitor 70 and an inductor 71, respectively. FM-broadcast signals only are allowed to pass through the capacitor 70, while AM-broadcast signals only are let to pass through the inductor 71.

What is claimed is:

1. An antenna input circuit for a radio receiver, comprising:

a first input transformer including a primary winding and a secondary winding, said primary winding having a grounded first end lead, a second end lead, and a tap lead;

a first capacitor connected across said first and second end leads to form a tuning circuit jointly with said primary winding;

a first antenna terminal connected to said tap lead of said primary winding;

a grounded second antenna terminal, said first and second antenna terminals being adapted to be connected with respective output leads of a low-impedance loop antenna having an inductance of 1 microhenry up to 100 microhenries for reception of medium-frequency-band radio waves;

a third and a fourth antenna terminal adapted to be connected to respective wires of a twin-lead type feeder extending from an antenna for receiving very-high-frequency-band radio waves;

a second input transformer including a primary winding and a secondary winding for very-high-frequency-band radio signal reception, said primary winding having a grounded center tap lead, a first end lead connected to said third antenna terminal and a second end lead connected to said fourth antenna terminal through a second capacitor which substantially prevents the passage therethrough of medium-frequency-band signals but passes very-high-frequency-band signals therethrough;

an inductor between said fouth antenna terminal and ground, and having substantially the same inductance as that of said low-impedance loop antenna; and short-circuiting means for short-circuiting said first and fourth antenna terminals when reception of medium-frequency-band radio waves is intended without the connection of said low-impedance loop antenna but with the connection of said very-high-frequency-band radio wave receiving antenna.

2. An antenna input circuit according to claim 1, in which: said short-circuiting means comprises a conductor member detachably attached across said first and fourth antenna terminals.

3. An antenna input circuit for a radio receiver, comprising:

a first input transformer including a primary winding and a secondary winding, said primary winding having a grounded first end lead, a second end lead, and a tap lead;

a first capacitor connected across said first and second end leads to form a tuning circuit jointly with said primary winding;

a first antenna terminal connected to said tap lead of said primary winding; and a grounded second antenna terminal, said first and second antenna terminals being adapted to be connected with respective output leads of a low-impedance loop antenna having an inductance of 1 microhenry up to 100 microhenries for reception of medium-frequency-band radio waves;

a third and a fourth antenna terminal adapted to be connected with a center wire and a shield sheath, respectively, of a coaxial cable extending from an antenna for receiving very-high-frequency-band radio waves;

a second input transformer including a primary winding and a secondary winding for very-high-frequency-band radio signal reception, said primary winding having a grounded lead and another lead connected to said third antenna terminal;

a second capacitor and an inductor arranged in parallel between said fourth antenna terminal and ground, said inductor having substantially the same inductance as that of said low-impedance loop antenna, said second capacitor substantially grounding said fourth antenna terminal for very-high-frequency-band signals but serving substantially as an impedance to medium-frequency-band signals; and short-circuiting means for short-circuiting said first and fourth antenna terminals when reception of medium-frequency-band radio waves is intended without the connection of said low-impedance loop antenna but with the connection of said very-high-frequency-band radio wave receiving antenna.

4. An antenna input circuit according to claim 3, in which: said short-circuiting means comprises a conductor member detachably attached across said first and fourth antenna terminals.

5. An antenna input circuit according to claim 1, further comprising:

a fifth and a sixth antenna terminal adapted to be connected to a center wire and shield sheath, respectively, of a coaxial cable extending from an antenna for receiving very-high-frequency-band radio waves, said fifth antenna terminal being connected to said second end lead of said primary winding of said second input transformer;

a third capacitor between said sixth antenna terminal and ground, which substantially grounds said sixth antenna terminal for very-high-frequency-band signals but serves substantially as an impedance to medium-frequency-band signals; and a resistor between said fourth and sixth antenna terminals.

6. An antenna input circuit according to claim 5, in which: said short-circuiting means comprises a conductor member detachably attached across said first and fourth antenna terminals.

7. An antenna input circuit according to claim 1, 3 or 5 further comprising a low-impedance loop antenna for receiving medium-frequency-band radio waves, said antenna including:

a conductor of at least one turn in the form of a substantially flat coil having an inductance of 1 microhenry up to 100 microhenries and having physical dimensions to provide an effective loop area larger than 20 $cm^2$ and being formed by a conductor wire, each end of said conductor being connected to one of said antenna terminals, respectively, said conductor wire being entirely enclosed in a sheath except for end leads of said conductor wire, said sheath being made with a non-magnetic material and extending along the shape of said loop antenna, whereby said loop antenna is capable of receiving the radio waves with substantial rejection of undesirable radations in the form of electric field from external noise sources and capable of being installed in a variety of manners as required.

8. An antenna input circuit according to claim 7, in which: said inductance is smaller than 30 microhenries.

9. An antenna input circuit according to claim 1, 3 or 5, in which:

said loop antenna is a substantially circular coil.

10. An antenna input circuit according to claim 1, 3 or 5, in which: said loop antenna is a substantially square coil.

11. An antenna input circuit according to claim 1, 3 or 5, in which: said loop antenna is a substantially rectangular coil.

12. An antenna input circuit according to claim 11, in which: said loop antenna excepting its end leads is entirely enclosed in a sheath of a non-magnetic material extending along the rectangular shape of said loop antenna, the sheath having on its surface a longitudinal rib to increase the rigidity of said loop antenna.

13. An antenna input circuit according to claim 1, 3 or 5 further comprising a low-impedance loop antenna for receiving medium-frequency-band radio waves, said antenna including:

a conductor of at least one turn in the form of a substantially flat coil having an inductance of 1 microhenry up to 100 microhenries and having physical dimensions to provide an effective loop area larger than 20 $cm^2$ and being formed by a conductor wire, said conductor wire being comprised of a coil pattern of a conductor layer printed on a plate member of a non-magnetic material by relying on circuit printing technique.

* * * * *